US006914575B2

(12) United States Patent
Rawnick et al.

(10) Patent No.: US 6,914,575 B2
(45) Date of Patent: Jul. 5, 2005

(54) SELECTABLE REFLECTOR AND SUB-REFLECTOR SYSTEM USING FLUIDIC DIELECTRICS

(75) Inventors: James J. Rawnick, Palm Bay, FL (US); Stephen B. Brown, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 15 days.

(21) Appl. No.: 10/634,219

(22) Filed: Aug. 5, 2003

(65) Prior Publication Data

US 2005/0030240 A1 Feb. 10, 2005

(51) Int. Cl.[7] ..... H01Q 13/00
(52) U.S. Cl. ..... 343/781 P; 343/781 CA
(58) Field of Search ..... 343/781 P, 781 CA, 343/786, 757, 840, 912, 775

(56) References Cited

U.S. PATENT DOCUMENTS 5,162,972 A 11/1992 Gripshover et al. ..... 361/277
5,792,236 A 8/1998 Taylor et al. ..... 75/715
6,429,823 B1 8/2002 Bains et al. ..... 343/755
6,515,235 B2 2/2003 Moller ..... 174/256
2004/0178966 A1 * 9/2004 Rawnick et al. ..... 343/912

OTHER PUBLICATIONS

U.S. Appl. No. 10/369,436, filed Feb. 18, 2003, Rawnick et al.
U.S. Appl. No. 10/387,208, filed Mar. 11, 2003, Rawnick et al.

(Continued)

*Primary Examiner*—Hoang V. Nguyen
(74) *Attorney, Agent, or Firm*—Sacco & Associates, PA

(57) ABSTRACT

A selectable sub-reflector antenna system (100) comprises a main reflector unit (101), a sub-reflector unit (111) disposed apart from the main reflector unit and having at least one cavity (116), and at least one fluidic dielectric having a permittivity and a permeability. The system further comprises at least one composition processor (104) adapted for dynamically changing a composition of the fluidic dielectric to vary at least one among the permittivity and permeability in at least one cavity among a plurality of cavities and a controller (102) for controlling the composition processor to selectively vary at least one among permittivity and permeability in at least one cavity in response to a control signal (105).

22 Claims, 3 Drawing Sheets

OTHER PUBLICATIONS

U.S. Appl. No. 10/330,755, filed Dec. 27, 2002, Rawnick et al.
U.S. Appl. No. 10/330,754, filed Dec. 27, 2002, Rawnick et al.
U.S. Appl. No. 10/300,456, filed Nov. 19, 2002, Rawnick et al.
U.S. Appl. No. 10/361,548, filed Feb. 10, 2003, Rawnick et al.
U.S. Appl. No. 10/387,209, filed Mar. 11, 2003, Rawnick et al.
U.S. Appl. No. 10/439,094, filed May 15, 2003, Rawnick et al.
U.S. Appl. No. 10/387,194, filed Mar. 11, 2003, Brown et al.
U.S. Appl. No. 10/438,435, filed May 15, 2003, Brown et al.
U.S. Appl. No. 10/414,696, filed Apr. 16, 2003, Brown et al.
U.S. Appl. No. 10/637,027, filed Aug. 7, 2003, Brown et al.
U.S. Appl. No. 10/414,650, filed Apr. 16, 2003, Brown et al.
U.S. Appl. No. 10/635,629, filed Aug. 6, 2003, Brown et al.
U.S. Appl. No. 10/459,067, filed Jun. 11, 2003, Brown et al.
U.S. Appl. No. 10/438,436, filed May 15, 2003, Rawnick et al.
U.S. Appl. No. 10/626,090, filed Jul. 24, 2003, Brown et al.
U.S. Appl. No. 10/635,582, filed Aug. 6, 2003, Rawnick et al.
U.S. Appl. No. 10/632,632, filed Aug. 1, 2003, Rawnick et al.
U.S. Appl. No. 10/614,149, filed Jul. 7, 2003, Brown et al.
U.S. Appl. No. 10/458,859, filed Jun. 11, 2003, Rawnick et al.
U.S. Appl. No. 624,378, filed Jul. 22, 2003, Brown et al.
U.S. Appl. No. 10/438,433, filed May 15, 2003, Rawnick et al.
U.S. Appl. No. 10/460,947, filed Jun. 13, 2003, Rawnick et al.
U.S. Appl. No. 10/421,352, filed Apr. 23, 2003, Rawnick et al.
U.S. Appl. No. 10/409,261, filed Apr. 8, 2003, Pike.
U.S. Appl. No. 10/441,743, filed May 19, 2003, Pike.
U.S. Appl. No. 10/628,846, filed Jul. 28, 2003, Pike et al.
U.S. Appl. No. 10/448,973, filed May 30, 2003, Delgado et al.
U.S. Appl. No. 10/300,455, filed Nov. 19, 2002, Brown et al.

* cited by examiner

PRIOR ART

SELECTABLE REFLECTOR AND SUB-REFLECTOR SYSTEM USING FLUIDIC DIELECTRICS

BACKGROUND OF THE INVENTION

1. Statement of the Technical Field

The present invention relates to the field of antennas, and more particularly to switchable sub-reflector antenna system using fluidic dielectrics.

2. Description of the Related Art

Typical satellite antenna systems use either parabolic reflectors or shaped reflectors to provide a specific beam coverage, or use a flat reflector system with an array of reflective printed patches or dipoles on the flat surface. These "reflect array" reflectors used in antennas are designed such that the reflective patches or dipoles shape the beam much like a shaped reflector or parabolic reflector would, but are much easier to manufacture and package on a spacecraft.

However, satellites typically are designed to provide a fixed satellite beam coverage for a given signal and may be limited in bandwidth by the structure of the reflectors and sub-reflectors. For example, Continental United States (CONUS) beams are designed to provide communications services to the entire continental United States. Once the satellite transmission system is designed and launched, changing the beam patterns to improve the operational bandwidth would be difficult.

The need to change the beam pattern provided by the satellite has become more desirable with the advent of direct broadcast satellites that provide communications services to specific areas and possibly on different frequency ranges. Without the ability to change beam patterns and coverage areas as well as to flexibly use multiple frequency ranges, additional satellites must be launched to provide the services to possible future subscribers, which increases the cost of delivering the services to existing customers.

Some existing systems are designed with minimal flexibility in the delivery of communications services. For example, a symmetrical Cassegrain antenna that uses a movable feed horn, defocuses the feed and zooms circular beams over a limited beam aspect ratio of 1:2.5. This scheme has high sidelobe gain and low beam-efficiency due to blockage by the feed horn and the subreflector of the Cassegrain system. Further, this type of system splits or bifurcates the main beam for beam aspect ratios greater than 2.5, resulting in low beam efficiency values. Other systems attempt to alter beam width and gain by using multiple feed horns. In any event, most of these systems will have a main reflected signal that will be interfered with by a sidelobe of the radiator or feed horn.

In another system as shown in FIG. 1, a dynamic reflector surface comprising an array of tunable reflective surfaces is used instead of a fixed reflector surface. Each element of the array can be tuned separately to change the phase during the process of reflection, and thus the beam pattern generated by the array of tunable reflectors can be changed in-flight in a simple manner. Each reflecting element in the array is a horn reflecting device which reflects an electric field emanating from a single feed horn. Each horn in the array has the capability of changing the phase during the process of incidence and reflection. This phase shift can then be used to change the shape of the beam emanating from the array. The phase shift can be incorporated by either using a movable short or by using a variable phase-shifter inside the horn and a short. By using "phase-shifting" which can be controlled on-orbit, a relatively simple reconfigurable antenna can be designed. This approach is much simpler than an active array in terms of cost and complexity.

More specifically, FIG. 1 illustrates a front, side, and isometric view of the existing horn reflect array as described in U.S. Pat. No. 6,429,823. Reflect array 200 is illuminated with RF energy from feed horn 202. Reflect array 200 comprises a plurality of reflective elements 204 that are configured in a reflector array 206. Side view 208 shows that feed horn 202 is pointed at the open end 210 of reflective element 204. Side view 208 also shows that reflector array 206 can be a curved array. Further, front view 212 and isometric view 214 show that reflective elements 204 can be placed in a circular arrangement for reflector array 206. Each reflective element 204 reflects a portion of the incident RF energy, and by changing the respective phase for each reflective element 204, the respective phase of the portion of the reflected RF energy for each respective reflective element 204 can be changed. By changing the phase of each portion of the reflected RF energy, different beam patterns can be generated by the horn reflect array. Although the reflector array 206 provides lower non-recurring costs for a satellite and can generate a plurality of different shaped beam patterns without reconfiguring the physical hardware, e.g., without moving the location of the feed horn 202 and the reflective elements 204 in the reflector array 206, the design is still too complicated to provide a simple mechanism able to switch a sub-reflector in and out of a reflection path. Reflect array 200 does not include a sub-reflector and would further require complex programming of reflective elements even if such elements were contemplated on a sub-reflector.

In any event, a programmable array such as the reflector array 206 can be reconfigured on-orbit. Satellites using the reflector array 206 can be designed for use in clear sky conditions, and, when necessary, the beams emanating from the reflector array 206 can be shaped to provide higher gains over geographic regions having rain or other poor transmission conditions, thus providing higher margins during clear sky conditions.

It can be seen, then, that there is a need in the art for an antenna system that can be alternatively reconfigured in-flight without the need for complex systems. It can also be seen that there is a need in the art for a communications system that can be reconfigured in-flight that has high beam-efficiencies and high beam aspect ratios. There is also a need for an antenna that is able to simply switch a sub-reflector on and off for use with multiple feed horns and that can optionally have the advantages of the antenna of FIG. 1 and other advantages as will be further described below utilizing fluidic dielectrics in accordance with the present invention.

Two important characteristics of dielectric materials are permittivity (sometimes called the relative permittivity or $\in_r$) and permeability (sometimes referred to as relative permeability or $\mu_r$). The relative permittivity and permeability determine the propagation velocity of a signal, which is approximately inversely proportional to $\sqrt{\mu\epsilon}$. The propagation velocity directly affects the electrical length of a transmission line and therefore the amount of delay introduced to signals that traverse the line.

Further, ignoring loss, the characteristic impedance of a transmission line, such as stripline or microstrip, is equal to $\sqrt{L_1/C_1}$ where $L_1$ is the inductance per unit length and $C_1$ is the capacitance per unit length. The values of $L_1$ and $C_1$ are generally determined by the permittivity and the permeability of the dielectric material(s) used to separate the transmission line structures as well as the physical geometry and spacing of the line structures.

For a given geometry, an increase in dielectric permittivity or permeability necessary for providing increased time delay will generally cause the characteristic impedance of the line to change. However, this is not a problem where only a fixed delay is needed, since the geometry of the transmission line can be readily designed and fabricated to achieve the proper characteristic impedance. Analogously, wave propagation delays and energy beam patterns through dielectric materials in reflector and/or sub-reflector based antenna systems are typically designed accordingly with a fixed dielectric permittivity or permeability. When various time delays are needed for specific energy shaping or beam forming requirements, however, such techniques have traditionally been viewed as impractical because of the obvious difficulties in dynamically varying the permittivity and/or permeability of a dielectric board substrate material. Accordingly, the only practical solution has been to design variable delay lines using conventional fixed length RF transmission lines with delay variability achieved using a series of electronically controlled switches. Such schemes would be impracticable and overly complicated for a reflector or sub-reflector based antenna.

SUMMARY OF THE INVENTION

The invention concerns an antenna utilizing a reflector and/or sub-reflector which includes at least one cavity and the presence, absence or mixture of fluidic dielectric in the cavity. A pump or a composition processor, for example, can be used to add, remove, or mix the fluidic dielectric to the cavity in response to a control signal. A sub-reflector can be selectively activated using the fluidic dielectric to reflect a first radiated signal or pass a second radiated signal. Additionally, a propagation delay or beam pattern or gain of a radiated signal through the antenna can be selectively varied by manipulating the fluidic dielectric through the cavity or cavities.

The fluidic dielectric can be comprised of an industrial solvent. If higher permeability or conductivity is desired, the industrial solvent can have a suspension of magnetic or conductive particles contained therein. The aforementioned particles can be formed of a wide variety of materials including those selected from the group consisting of ferrite, metallic salts, and organo-metallic particles.

In accordance with a first embodiment of the present invention, a selectable sub-reflector antenna system comprises a main reflector unit, a sub-reflector unit disposed apart from the main reflector unit and having at least one cavity, and at least one fluidic dielectric having a permittivity and a permeability. The system further comprises at least one composition processor adapted for dynamically changing a composition of the fluidic dielectric to vary at least one among the permittivity and permeability in at least one cavity among a plurality of cavities and a controller for controlling said composition processor to selectively vary at least one among permittivity and permeability in at least one cavity in response to a control signal.

In accordance with a second embodiment of the present invention, a selectable sub-reflector antenna system comprises a main reflector unit, a sub-reflector unit disposed apart from the main reflector unit and having at least one cavity, and at least one fluidic dielectric having a permittivity and a permeability. The system in accordance with this second embodiment further comprises at least one fluidic pump unit for moving the fluidic dielectric among at least one cavity and a reservoir for adding and removing said fluid dielectric to at least one cavity in response to a control signal.

In yet another embodiment of the present invention, a method for selectively activating a sub-reflector in a reflector antenna system comprises the steps of reflecting a first radiated signal from the sub-reflector from a first source toward a main reflector in a first mode wherein the sub-reflector is activated using at least a fluidic dielectric and transmitting a second radiated signal through the sub-reflector from a second source toward the main reflector in a second mode wherein the sub-reflector is inactivated at least in part by changing the fluidic dielectric.

DETAILED DESCRIPTION OF THE INVENTION

Figure 1:
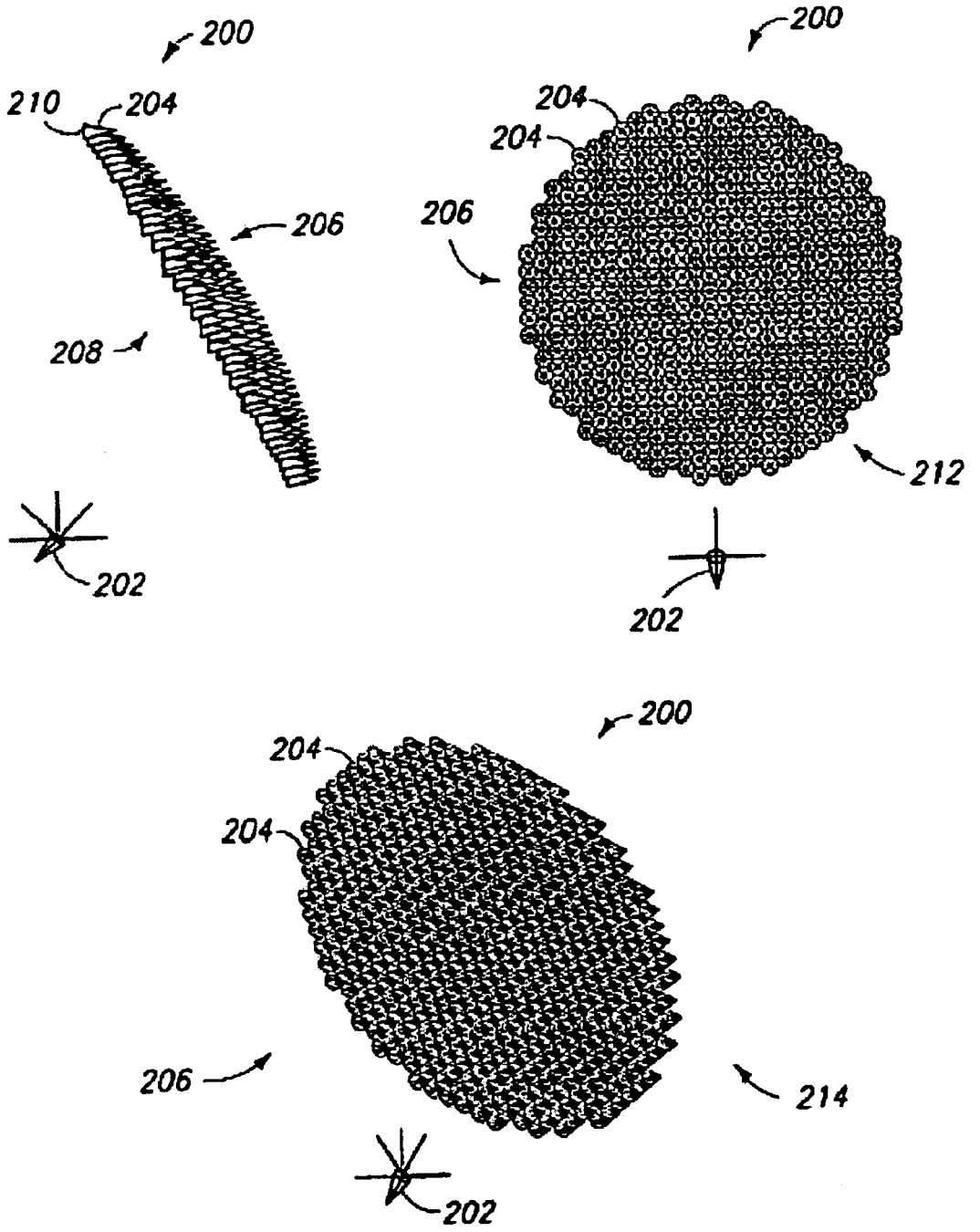
FIG. 1 illustrates a front, side, and isometric view of a horn reflect array of an existing antenna system.

Although the antenna of FIG. 1 provides more flexibility than a conventional satellite reflector antenna, it is the ability to vary the dielectric value of a reflective element in the antenna of the present invention that enables it to be used in more than just a particular application or operating range. Reflectors and sub-reflectors in prior antennas all have static or fixed dielectric values. In contrast, the present invention utilizes a fluidic cavity as shall hereinafter be described in greater detail to provide even greater design flexibility for antennas capable of further applications and structures and wider operating ranges.

Figure 2:
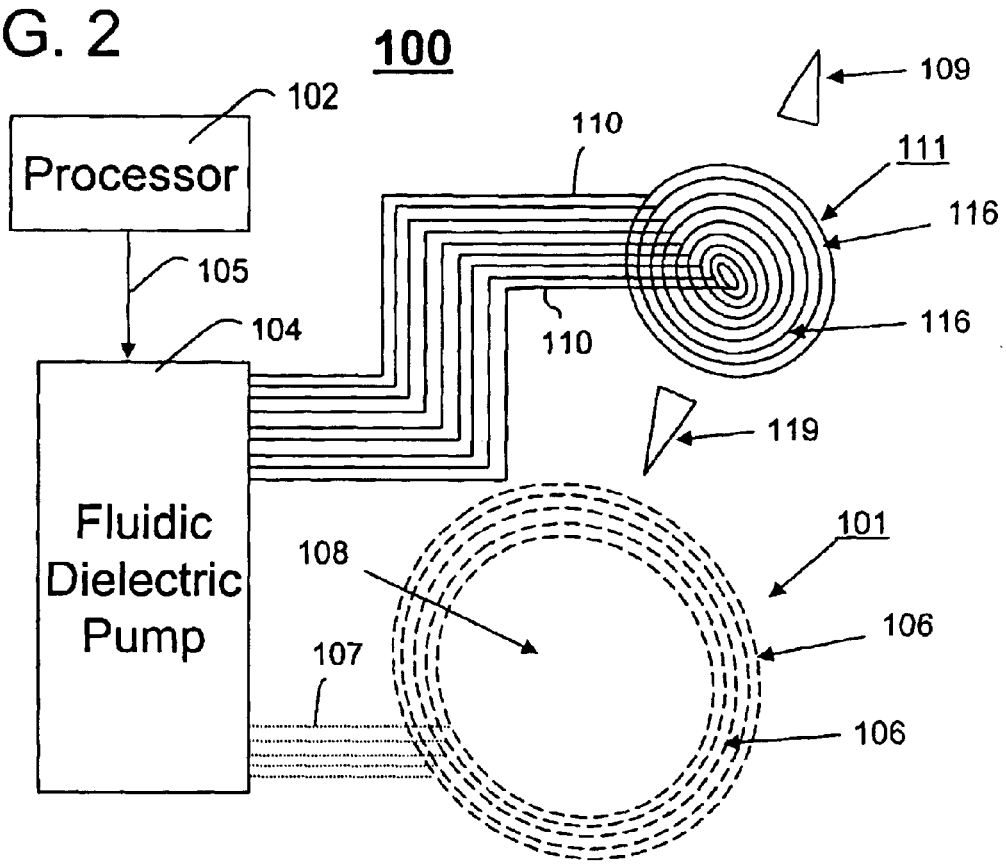
FIG. 2 is a schematic diagram of a selectable sub-reflector antenna system in accordance with the present invention.
Figure 3:
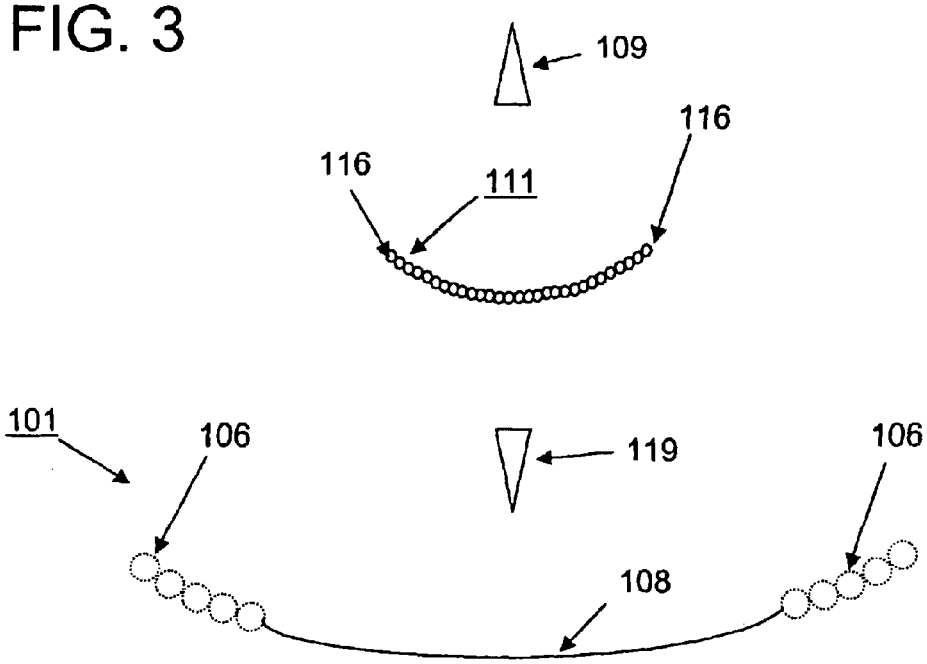
FIG. 3 is a side view of the selectable sub-reflector antenna system of FIG. 2.

Referring to FIGS. 2 and 3, a schematic diagram of an antenna system 100 using a sub-reflector unit 111 having at least one cavity or a plurality of cavities 116 that can contain at least one fluidic dielectric having a permittivity and a permeability is shown. The cavities 116 can be a plurality of concentric tubes such as quartz capillary tubes on the outer periphery of the sub-reflector unit 111, although the invention is not limited to such arrangement in terms of cavities and construction. For example, it many instances it may be preferable to have only one cavity in the sub-reflector unit 111. The antenna 100 can further include at least one composition processor or pump 104 adapted for dynamically changing a composition of the fluidic dielectric to vary at least the permittivity and/or permeability in any of the plurality of cavities 116. It should be understood that the at least one composition processor can be independently operable for adding and removing the fluidic dielectric from each of the plurality of cavities or from a single cavity (as the case may be). The fluidic dielectric can be moved in and out of the respective cavities using feed lines 110 for example. The antenna 100 can further include a controller or processor 102 for controlling the composition processor 104 to selectively vary at least one of the permittivity and/or the permeability in at least one of the plurality of cavities in response to a control signal.

The cavity or cavities in the sub-reflector primarily serves to selectively activate the sub-reflector 111 by reflecting a first radiated signal from the sub-reflector 111 from a first source such as feed horn 119 toward a main reflector 101 in a first mode wherein the sub-reflector 111 is activated using at least a fluidic dielectric. In a second mode, the sub-reflector 111 allows a second radiated signal from a second source such as feed horn 109 to transmit through the sub-reflector 111 toward the main reflector 101 wherein the sub-reflector is inactivated at least in part by changing the fluidic dielectric. By changing the fluidic dielectric, it is meant to be understood that the fluidic dielectric in at least a cavity of the sub-reflector is either completely or partially removed or that the mixture of fluidic dielectric material within the cavity is changed. The main reflector unit 101 is preferably spaced apart from a feed horn or radiator 109 that radiates towards the main reflector unit 101 (and through the sub-reflector unit 111 in the second mode. The sub-reflector unit 111 is preferably placed between a second feed horn or radiator 119 and the feed horn 119. The sub-reflector unit 111 in the first mode reflects a radiated from the feed horn 119 towards the main reflector unit 101.

It should be noted that the main reflector unit 101 can be completely be composed of a solid dielectric material or can further comprise at least one cavity or a plurality of cavities 106 that can contain at least one fluidic dielectric having a permittivity and a permeability. The cavities 106 can be a plurality of concentric tubes such as quartz capillary tubes on the outer periphery of the sub-reflector unit 101, although the invention is not limited to such arrangement in terms of cavities and construction. The fluidic dielectric can be moved in and out of the respective cavities using feed lines 107 and the pump or composition processor 104 for example. As previously described, the fluidic dielectric used in the cavities of the sub-reflector 111 and as optionally used in the main reflector unit 11 can be comprised of an industrial solvent having a suspension of magnetic or conductive particles. The particles are preferably formed of a material selected from the group consisting of ferrite, metallic salts, and organo-metallic particles although the invention is not limited to such compositions.

Referring again to FIG. 2, the controller or processor 102 is preferably provided for controlling operation of the antenna 100 in response to a control signal 105. The controller 102 can be in the form of a microprocessor with associated memory, a general purpose computer, or could be implemented as a simple look-up table.

For the purpose of introducing time delay or energy shaping in accordance with one aspect of the present invention, the exact size, location and geometry of the cavity structure as well as the permittivity and permeability characteristics of the fluidic dielectric can play an important role. The energy shaping features are particularly applicable to the main reflector unit 101 in the present invention since the sub-reflector 111 preferably operates as a switch either reflecting or allowing a radiated signal through. Even so, the energy shaping concepts may equally be applicable to the sub-reflector 111 in particular applications. The processor and pump or flow control device (102 and 104) can be any suitable arrangement of valves and/or pumps as may be necessary to independently adjust the relative amount of fluidic dielectric contained in the cavities 106. Even a MEMS type pump device (not shown) can be interposed between the cavity and a reservoir for this purpose. However, those skilled in the art will readily appreciate that the invention is not so limited as MEMS type valves and/or larger scale pump and valve devices can also be used as would be recognized by those skilled in the art.

Figure 4:
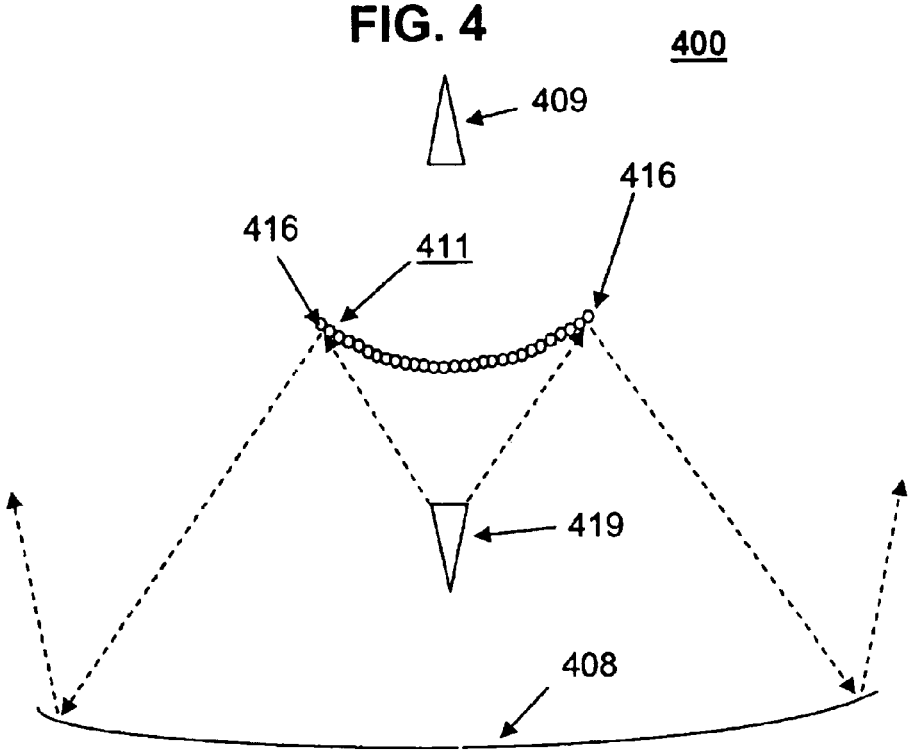
FIG. 4 is a side view of an selectable sub-reflector antenna system with the sub-reflector activated in accordance with the present invention.
Figure 5:
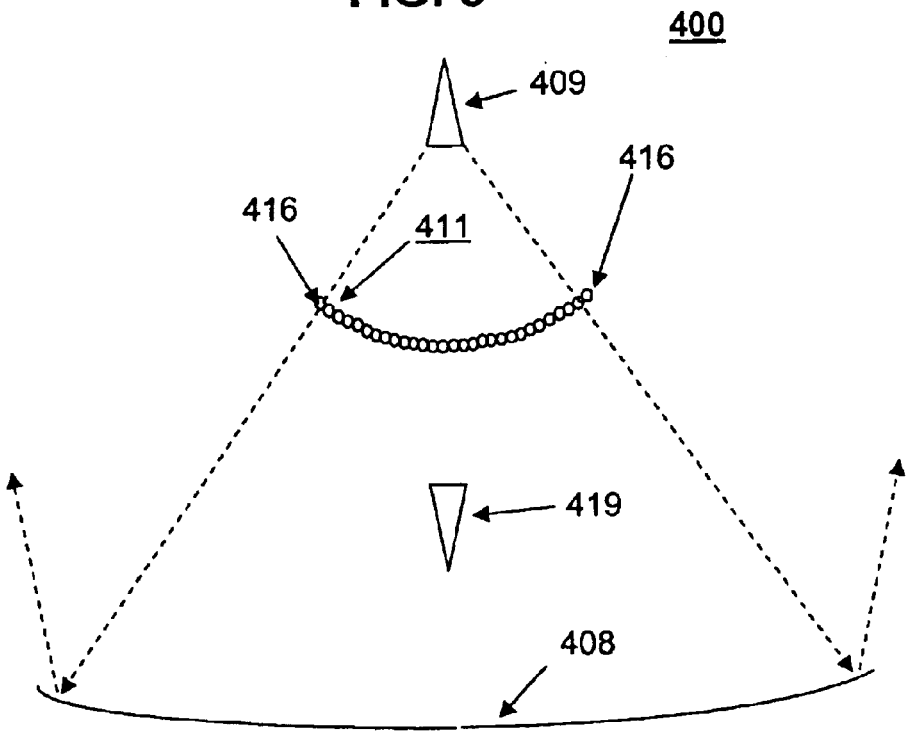
FIG. 5 is a side view of an selectable sub-reflector antenna system with the sub-reflector inactivated in accordance with the present invention.

The flow control device can ideally cause the fluidic dielectric to completely or partially fill any or all of the cavities 106 (or cavities 416 in FIGS. 4 & 5). The flow control device can also cause the fluidic dielectric to be evacuated from the cavity into a reservoir (not shown). According to a preferred embodiment, each flow control device is preferably independently operable by controller 102 so that fluidic dielectric can be added or removed from selected ones of the cavities 106 to produce the required amount of delay indicated by a control signal 105.

Propagation delay of signals in the antenna system 100 can be controlled by selectively controlling the presence and removal or mixture of fluidic dielectric from the cavities 106. Since the propagation velocity of a signal is approximately inversely proportional to $\sqrt{\mu\epsilon}$, the different permittivity and/or permeability of the fluidic dielectric as compared to an empty cavity (or a cavity having a different mixture with different dielectric properties) will cause the propagation velocity (and therefore the amount of delay introduced)) to be different.

According to yet another embodiment of the invention, different ones of the cavities 106 can have different types of fluidic dielectric contained therein so as to produce different amounts of delay for RF signals traversing the antenna 100. For example, larger amounts of delay can be introduced by using fluidic dielectrics with proportionately higher values of permittivity and permeability. Using this technique, coarse and fine adjustments can be effected in the total amount of delay introduced or in the desired energy shaping of the radiated signal.

As previously noted, the invention is not limited to any particular type of structure. The cavities do not necessarily need to be tubes or in concentric arrangements as shown, but can be formed in various arrangements to accomplish the objectives of the present invention.

Composition of the Fluidic Dielectric

The fluidic dielectric can be comprised of any fluid composition having the required characteristics of permittivity and permeability as may be necessary for achieving a selected range of delay. Those skilled in the art will recognize that one or more component parts can be mixed together to produce a desired permeability and permittivity required for a particular time delay or radiated energy shape. In this regard, it will be readily appreciated that fluid miscibility can be a key consideration to ensure proper mixing of the component parts of the fluidic dielectric.

The fluidic dielectric also preferably has a relatively low loss tangent to minimize the amount of RF energy lost in the antenna. Aside from the foregoing constraints, there are relatively few limits on the range of materials that can be used to form the fluidic dielectric. Accordingly, those skilled in the art will recognize that the examples of suitable fluidic dielectrics as shall be disclosed herein are merely by way of example and are not intended to limit in any way the scope of the invention. Also, while component materials can be mixed in order to produce the fluidic dielectric as described herein, it should be noted that the invention is not so limited. Instead, the composition of the fluidic dielectric could be formed in other ways. All such techniques will be understood to be included within the scope of the invention.

Those skilled in the art will recognize that a nominal value of permittivity ($\epsilon_r$) for fluids is approximately 2.0. However, the fluidic dielectric used herein can include fluids with higher values of permittivity. For example, the fluidic dielectric material could be selected to have a permittivity values of between 2.0 and about 58, depending upon the amount of delay or energy shape required.

Similarly, the fluidic dielectric can have a wide range of permeability values. High levels of magnetic permeability are commonly observed in magnetic metals such as Fe and Co. For example, solid alloys of these materials can exhibit levels of $\mu_r$ in excess of one thousand. By comparison, the permeability of fluids is nominally about 1.0 and they generally do not exhibit high levels of permeability. However, high permeability can be achieved in a fluid by introducing metal particles/elements to the fluid. For example typical magnetic fluids comprise suspensions of ferro-magnetic particles in a conventional industrial solvent such as water, toluene, mineral oil, silicone, and so on. Other types of magnetic particles include metallic salts, organometallic compounds, and other derivatives, although Fe and Co particles are most common. The size of the magnetic particles found in such systems is known to vary to some extent. However, particles sizes in the range of 1 nm to 20 $\mu$m are common. The composition of particles can be selected as necessary to achieve the required permeability in the final fluidic dielectric. Magnetic fluid compositions are typically between about 50% to 90% particles by weight. Increasing the number of particles will generally increase the permeability.

Example of materials that could be used to produce fluidic dielectric materials as described herein would include oil (low permittivity, low permeability), a solvent (high permittivity, low permeability) and a magnetic fluid, such as combination of a solvent and a ferrite (high permittivity and high permeability). A hydrocarbon dielectric oil such as Vacuum Pump Oil MSDS-12602 could be used to realize a low permittivity, low permeability fluid, low electrical loss fluid. A low permittivity, high permeability fluid may be realized by mixing same hydrocarbon fluid with magnetic particles such as magnetite manufactured by FerroTec Corporation of Nashua, N.H., or iron-nickel metal powders manufactured by Lord Corporation of Cary, N.C. for use in ferrofluids and magnetoresrictive (MR) fluids. Additional ingredients such as surfactants may be included to promote uniform dispersion of the particle. Fluids containing electrically conductive magnetic particles require a mix ratio low enough to ensure that no electrical path can be created in the mixture. Solvents such as formamide inherently posses a relatively high permittivity. Similar techniques could be used to produce fluidic dielectrics with higher permittivity. For example, fluid permittivity could be increased by adding high permittivity powders such as barium titanate manufactured by Ferro Corporation of Cleveland, Ohio. For broadband applications, the fluids would not have significant resonances over the frequency band of interest.

For conductive fluids, a liquid metal such as mercury or a solvent-electrolyte mixture could be employed. A system which relies on the presence or absence of a conductive fluid must ensure that no conductive residue remains in/on the walls of the fluid channels when the radome needs to be in the "RF transparent" state. It is believed that cases exist which illustrate that this condition can be met, in some instances with a passive system. An example is a commonly used mercury thermometer. As the mercury, which is a conductive liquid, is drawn down the tube in response to decreasing temperature the surface tension of the fluid draws all material along and does not leave "residue" or particulate matter on the sides of the transport tube. For other conductive fluids which may consist of particles in solution or suspension, an active purging system may be employed which uses a non-conductive fluid to flush the channel of any remaining conductive particles.

The antennas of FIGS. 4–5 also reveals a method for selectively activating a sub-reflector 411 in a reflector antenna system 400 comprising the steps of reflecting a first radiated signal from the sub-reflector 411 from a first source 419 toward a main reflector 408 in a first mode as shown in FIG. 4 wherein the sub-reflector 411 is activated using at least a fluidic dielectric in at least one cavity 416 of the sub-reflector 411. The sub-reflector 411 in a second mode as shown in FIG. 5 enables the transmission of a second radiated signal through the sub-reflector 411 from a second source 409 toward the main reflector 408 wherein the sub-reflector is inactivated at least in part by changing the fluidic dielectric. By changing the fluidic dielectric, it should be understood that it can comprise the step of removing all or a portion of the fluidic dielectric from at least one cavity in the sub-reflector or changing the mixture or composition of the fluidic dielectric in at least one cavity. The method could further comprise the steps of adding and removing a fluidic dielectric to at least one cavity (106) within the main reflector unit (101) to vary a propagation delay of said radio frequency signal or to obtain a desired permeability and permittivity. According to a preferred embodiment, each cavity can be either made full or empty of fluidic dielectric in order to implement the required time delay or energy shape. However, the invention is not so limited and it is also possible to only partially fill or partially drain the fluidic dielectric from one or more of the cavities.

In either case, once the controller has determined the updated configuration for each of the cavities necessary to implement the time delay, the controller can operate device 104 to implement the required delay. The required configuration can be determined by one of several means. One method would be to calculate the total time delay for each cavity or for all the cavities at once. Given the permittivity and permeability of the fluid dielectrics in the cavities, and any surrounding solid dielectric (108 in FIG. 3 for example), the propagation velocity could be calculated for the reflector unit. These values could be calculated each time a new delay time request is received or particular energy is required or could be stored in a memory associated with controller or processor 102.

As an alternative to calculating the required configuration for a given delay or energy shape, the controller 102 could also make use of a look-up-table (LUT). The LUT can contain cross-reference information for determining control data for fluidic delay units necessary to achieve various different delay times and energy shapes. For example, a calibration process could be used to identify the specific digital control signal values communicated from controller 102 to the cavities that are necessary to achieve a specific delay value or energy shape. These digital control signal values could then be stored in the LUT. Thereafter, when control signal 105 is updated to a new requested delay time, the controller 102 can immediately obtain the corresponding digital control signal for producing the required delay.

As an alternative, or in addition to the foregoing methods, the controller 102 could make use of an empirical approach that injects a signal at an RF input port and measures the delay to an RF output port. Specifically, the controller 102 could check to see whether the appropriate time delay or energy shape had been achieved. A feedback loop could then be employed to control the flow control devices (104) to produce the desired delay characteristic.

The present invention is ideally applicable to any sub-reflector type antenna. Operationally, the present invention enables a system designer to alter the size of the reflective surface for a given application or frequency range and allows the use of multiple feed horns that normally would not operate appropriately on a single system by using a switch mechanism facilitated by the use of fluidic dielectric. The present invention adds further flexibility by controlling the reflection off the surface of the reflectors by dynamically changing the size of the surface with the fluidic dielectric. In essence, the reflector size can be made to vary based on the frequency or application as opposed to existing systems that are constructed on the basis of fixed frequencies since feeds are frequency dependent generally. In this manner, sidelobes created by different feed horns can each be independently averted and not reflected as required by manipulating the size of the reflectors or sub-reflectors using the fluidic dielectric. In one embodiment, when the fluidic dielectric is present, the reflector or sub-reflector is effectively extended in size and when the fluidic dielectric is removed the reflector or sub-reflector is effectively reduced in size.

Those skilled in the art will recognize that a wide variety of alternatives could be used to adjust the presence or absence or mixture of the fluid dielectric contained in each of the cavities. Additionally, those skilled in the art should also recognize that a wide variety of configurations in terms of cavities and reflectors or sub-reflectors could also be used with the present invention. The reflector or sub-reflector of the present invention can be assembled in a configuration that resembles a reflector in forms such as parabolic, circular, flat, etc, depending on the desires of the designer for the available or desired beam patterns antenna. Accordingly, the specific implementations described herein are intended to be merely examples and should not be construed as limiting the invention.

We claim:

1. A selectable sub-reflector antenna system, comprising:

a main reflector unit;

a sub-reflector unit disposed apart from the main reflector unit and having at least one cavity;

at least one fluidic dielectric having a permittivity and a permeability;

at least one composition processor adapted for dynamically changing a composition of said fluidic dielectric to vary at least one of said permittivity and said permeability in said at least one cavity; and a controller for controlling said composition processor to selectively vary at least one of said permittivity and said permeability in said at least one cavity in response to a control signal.

2. The antenna system of claim 1, wherein said at least one cavity comprises a plurality of cavities.

3. The reflector antenna of claim 2, wherein the plurality of cavities comprises a plurality of concentric tubes consisting of quartz capillary tubes.

4. The antenna system of claim 1, wherein the main reflector unit comprises a reflector portion surrounded on its periphery by at least one cavity capable of being changed with the composition of fluidic dielectric by the at least one composition processor.

5. The antenna system of claim 1, wherein the main reflector unit is a solid dielectric substrate.

6. The antenna system of claim 2, wherein each of said at least one composition processor is independently operable for adding and removing said fluidic dielectric from each of said plurality of cavities.

7. The antenna system according to claim 1, wherein said fluidic dielectric is comprised of an industrial solvent.

8. The antenna system according to claim 7, wherein said fluidic dielectric is comprised of an industrial solvent that has a suspension of magnetic particles contained therein.

9. The antenna system according to claim 8, wherein said magnetic particles are formed of a material selected from the group consisting of ferrite, metallic salts, and organo-metallic particles.

10. The antenna system according to claim 1, wherein the antenna system further comprises at least one feed horn spaced between the main reflector unit and the sub-reflector unit for generating a radiated signal that is selectively reflected from the sub-reflector unit towards the main reflector unit using the fluidic dielectric.

11. The antenna system according to claim 10, wherein the antenna system further comprises at least one feed horn spaced above the sub-reflector unit for generating a radiated signal that is selectively transmitted through the sub-reflector unit towards the main reflector unit.

12. A selectable sub-reflector antenna system, comprising:

a main reflector unit;

a sub-reflector unit disposed apart from the main reflector unit and having at least one cavity;

at least one fluidic dielectric having a permittivity and a permeability; and at least one fluidic pump unit for moving said at least one fluidic dielectric among at least one cavity and a reservoir for adding and removing said fluid dielectric to said at least one cavity in response to a control signal.

13. The antenna system of claim 12, wherein said at least one cavity comprises a plurality of cavities.

14. The reflector antenna of claim 13, wherein the plurality of cavities comprises a plurality of concentric tubes consisting of quartz capillary tubes.

15. The antenna system of claim 12, wherein the main reflector unit comprises a reflector portion surrounded on its periphery by at least one cavity capable of being changed with the composition of fluidic dielectric by the at least one pump unit.

16. The antenna system according to claim 12, wherein said fluidic dielectric is comprised of an industrial solvent having a suspension of magnetic particles contained therein, wherein said magnetic particles are formed of a material selected from the group consisting of ferrite, metallic salts, and organo-metallic particles.

17. The antenna system according to claim 12, wherein the antenna system further comprises at least one feed horn spaced between the main reflector unit and the sub-reflector unit for generating a radiated signal that is selectively reflected from the sub-reflector unit towards the main reflector unit using the fluidic dielectric and further comprises at least one feed horn spaced above the sub-reflector unit for generating a radiated signal that is selectively transmitted through the sub-reflector unit towards the main reflector unit.

18. A method for selectively activating a sub-reflector in a reflector antenna system, comprising the steps of:

reflecting a first radiated signal from the sub-reflector from a first source toward a main reflector in a first mode wherein the sub-reflector is activated using at least a fluidic dielectric; and transmitting a second radiated signal through the sub-reflector from a second source toward the main reflector in a second mode wherein the sub-reflector is inactivated at least in part by changing the fluidic dielectric.

19. The method of claim 18, wherein the step of changing the fluidic dielectric comprises the step of removing the fluidic dielectric from at least one cavity in the sub-reflector.

20. The method of claim 18, wherein the method further comprises the step of dynamically adding and removing a fluidic dielectric to at least one cavity within the main reflector unit to vary a propagation delay of said radio frequency signal.

21. The method according to claim 20, further comprising the step of selectively adding and removing a fluidic dielectric from selected ones of a plurality of said cavities of the reflector antenna in response to a control signal.

22. The method according to claim 21, wherein the step of selectively adding and removing a fluidic dielectric comprises the step of mixing fluidic dielectric to obtain a desired permeability and permittivity.

* * * * *